US011548118B2

(12) United States Patent
Ghinassi et al.

(10) Patent No.: US 11,548,118 B2
(45) Date of Patent: Jan. 10, 2023

(54) ADJUSTABLE BAR-GUIDING DEVICE

(71) Applicant: BUCCI AUTOMATIONS S.P.A., Faenza (IT)

(72) Inventors: Andrea Ghinassi, Faenza (IT); Marco Malucelli, Forli' (IT); Andrea Frattini, Faenza (IT)

(73) Assignee: BUCCI AUTOMATIONS S.P.A., Faenza (IT)

( * ) Notice: Subject to any disclaimer, the term of this patent is extended or adjusted under 35 U.S.C. 154(b) by 289 days.

(21) Appl. No.: 16/955,607

(22) PCT Filed: Dec. 22, 2017

(86) PCT No.: PCT/IT2017/000293
§ 371 (c)(1),
(2) Date: Jun. 18, 2020

(87) PCT Pub. No.: WO2019/123495
PCT Pub. Date: Jun. 27, 2019

(65) Prior Publication Data

US 2021/0094150 A1 Apr. 1, 2021

(51) Int. Cl.
*B25B 5/08* (2006.01)

(52) U.S. Cl.
CPC ..... *B25B 5/087* (2013.01)

(58) Field of Classification Search
CPC ..... B25B 5/087; B25B 5/06; B25B 5/085; B25B 5/02; B25B 1/24; B25B 1/02; F16B 2/12
See application file for complete search history.

(56) References Cited

U.S. PATENT DOCUMENTS 252,632 A * 1/1882 Tatro ..... B25B 1/2452 269/272
1,242,426 A * 10/1917 Sana ..... B25B 1/125 269/208
4,647,100 A 3/1987 Lessway
(Continued)

FOREIGN PATENT DOCUMENTS

CN 103659274 A 3/2014
CN 204148888 U 2/2015
(Continued)

OTHER PUBLICATIONS

JP Office Action dated Nov. 26, 2021 re: Application No. 2020-526022, pp. 1-22, citing: JP3146667, EP00384344, JP2002-018602A, US2001/047924, JPS 59-090594U, JP S 61-168482A, JP S 55-031538A, JP S 57-156187A and JP 2009-006474A.
(Continued)

*Primary Examiner* — Anita M King
(74) *Attorney, Agent, or Firm* — Cantor Colburn LLP

(57) ABSTRACT

An adjustable bar-guiding device includes at least one pair of complementarily-shaped jaws which are slideably associated with a fixed frame with the interposition of at least one movement lever mechanism which is actuated by at least one fluid cylinder. The jaws perform a translational motion according to a stroke of mutual approach/spacing apart, between a first configuration of substantial juxtaposition of their respective surfaces and a second configuration in which the surfaces are located at a predefined distance for containing a bar.

8 Claims, 2 Drawing Sheets

(56) References Cited

U.S. PATENT DOCUMENTS

| | | | | |
|---|---|---|---|---|
| 6,386,532 | B1 * | 5/2002 | Donovan | B25B 5/061 269/25 |
| 7,837,247 | B2 * | 11/2010 | Waldorf | B25B 5/087 294/203 |
| 8,177,209 | B2 * | 5/2012 | Chen | B25B 5/08 269/95 |
| 8,517,366 | B2 * | 8/2013 | Seber | B25B 1/125 269/182 |
| 9,022,334 | B1 * | 5/2015 | DeMayo | A61G 13/101 248/229.24 |
| 9,839,985 | B1 | 12/2017 | Lessway | |
| 2001/0047924 | A1 | 12/2001 | Scemama | |
| 2612/0306138 | | 12/2012 | Zhang | |

FOREIGN PATENT DOCUMENTS

| | | | |
|---|---|---|---|
| CN | 105880679 | A | 8/2016 |
| CN | 106181800 | A | 12/2016 |
| DE | 2741581 | A1 | 3/1979 |
| DE | 102008035021 | A1 | 1/2010 |
| EP | 0384344 | A2 | 8/1990 |
| GB | 565401 | A | 11/1944 |
| JP | S5531538 | A | 3/1980 |
| JP | S57156187 | A | 9/1982 |
| JP | S5990594 | U | 6/1984 |
| JP | S61168482 | A | 7/1986 |
| JP | H11182417 | A | 7/1999 |
| JP | 2002018602 | A | 1/2002 |
| JP | 3146667 | U | 11/2008 |
| JP | 2009006474 | A | 1/2009 |
| JP | 2017048842 | A | 3/2017 |
| JP | 2017078507 | A | 4/2017 |

OTHER PUBLICATIONS

International Search Report dated Sep. 13, 2018 re: Application No. PCT/IT2017/000293, pp. 1-3, citing: U.S. Pat. No. 9,339,985 B1, U.S. Pat. No. 4,647,100 A, DE 27 41 581 A1 and DE 10 2008 035021 A1.

Written Opinion dated Sep. 13, 2018 re: Application No. PCT/IT2017/000293, pp. 1-5, citing: U.S. Pat. No. 9,839,985 B1, U.S. Pat. No. 4,647,100 A, DE 27 41 581 A1 and DE 10 2008 035021 A1.

JP Office Action dated Apr. 8, 2022 re: Application No. 2020-526022, pp. 1-15, citing: JP 3146667, EP 0384344, JP 2002-18602A, JP S59-90594U, JP S61-168482A, JP S57-156187A, JP 2017-78507A, JP 2017-48842A and JP H11-182417A.

* cited by examiner

ADJUSTABLE BAR-GUIDING DEVICE

TECHNICAL FIELD

The present disclosure relates to an adjustable bar-guiding device.

BACKGROUND

An automatic bar loader is an accessory that can be applied to a lathe and its function is to keep constant the flow of material to the machine tool, in order to ensure that the latter item can carry out the respective machining operations continuously.

Such continuous supply of raw material is achieved by way of a storage magazine for bars, from which the bars are taken as the bar being subjected to machining by the lathe is running out, instant by instant.

The loader also takes care of handling all the problems deriving from the use of a slender bar, even of considerable length (up to 6 meters), made to rotate at high angular speeds.

It should furthermore be noted that bar loaders must not in any way limit the productivity of the lathes with which they are associated and they must ensure the minimization of setup times and machine shutdown times owing to maintenance operations.

The two requirements that drive design, however, in some cases are opposed in that a high rate of productivity cannot be easily reconciled with the versatility and flexibility desired by the end customer.

Currently, there are two separate categories of machines: a first category adopts a guide which is constituted by a continuous channel, while a second category adopts discrete means of support arranged in series.

In both cases it is difficult to perfectly reconcile performance and flexibility.

In one widespread implementation solution, loaders are fitted with a continuous guide channel which is made up of semicircular sectors made of metallic or plastic material.

The feature of this type of guide is that it ensures a fairly high level of performance at the expense of rapidity of change of format (re-setup).

In this case, in fact, the operation to change diameter entails the substitution of the entire channel with guide sectors that have the right diameter for the new bar.

After this operation, the pusher wand must also be replaced, with corresponding cost in terms of time and energy by the operator.

Furthermore, the gripper also needs to be changed, the size of which must correspond to the bar, in order to ensure the coupling and the recovery of the piece after the machining.

In recent years, some manufacturers have started to place much more emphasis on flexibility in their machines, while at the same time seeking not to lose the performance levels achieved.

In order to achieve this object, inside the loader a series of mobile bushings have been inserted which are dedicated to guiding the bar.

This makes it possible to avoid the substitution of the entire guide channel and of the pusher, thus limiting the re-setup operations to simply substituting the gripper at the head of the pusher and, optionally, the shells that constitute the moving bushing.

In the most extreme applications, the mobile bushings do not even require substitution.

This is possible by virtue of their offset arrangement, which enables an intersection of the geometry in order to make it possible to come into contact on every bar diameter.

This implementation solution enables the operator, when changing the diameter of the bar being machined, to set only the new value from the control panel. With this operation a set of cams is adjusted so as to constitute a mechanical locking of the stroke limit in the final position, in order to allow the correct closure arrangement of the bushings. The mechanical locking is useful in that a direct sliding between the rotating bar and the containment bushing would risk modifying the superficial quality of the material, in addition to considerably lessening the life of the guiding element.

The presence of a mechanical locking stroke limit complicates the structure of the guide and, at the same time, requires a very precise adjustment of the bar diameter by the operator.

Both such characteristics are negative, because a complex loader is more easily subject to malfunctions and, in addition, its correct operation is always subject to the expertise and to the professionalism of the designated operator.

SUMMARY

The aim of the present disclosure is to solve the above-mentioned drawbacks by providing an adjustable bar-guiding device that does not require the intervention of the operator for operations to change format.

Within this aim, the disclosure provides an adjustable bar-guiding device that has a simple structure.

The disclosure also provides an adjustable bar-guiding device that is constituted by commercial components and/or components that are easily sourced.

The present disclosure further provides an adjustable bar-guiding device which is low cost, easily and practically implemented and safely applied.

This aim and these and other advantages which will become better apparent hereinafter are achieved by providing an adjustable bar-guiding device, characterized in that it comprises at least one pair of complementarily-shaped jaws which are slideably associated with a fixed frame with the interposition of at least one movement lever mechanism which is actuated by at least one fluid cylinder, said jaws performing a translational motion according to a stroke of mutual approach/spacing apart, between a first configuration of substantial juxtaposition of respective surfaces of said jaws and a second configuration in which said surfaces are located at a predefined distance for containing a bar.

BRIEF DESCRIPTION OF THE DRAWINGS

Further characteristics and advantages of the disclosure will become better apparent from the description of a preferred, but not exclusive, embodiment of the adjustable bar-guiding device according to the disclosure, which is illustrated by way of non-limiting example in the accompanying drawings wherein.

DETAILED DESCRIPTION OF THE DRAWINGS

Figure 1:
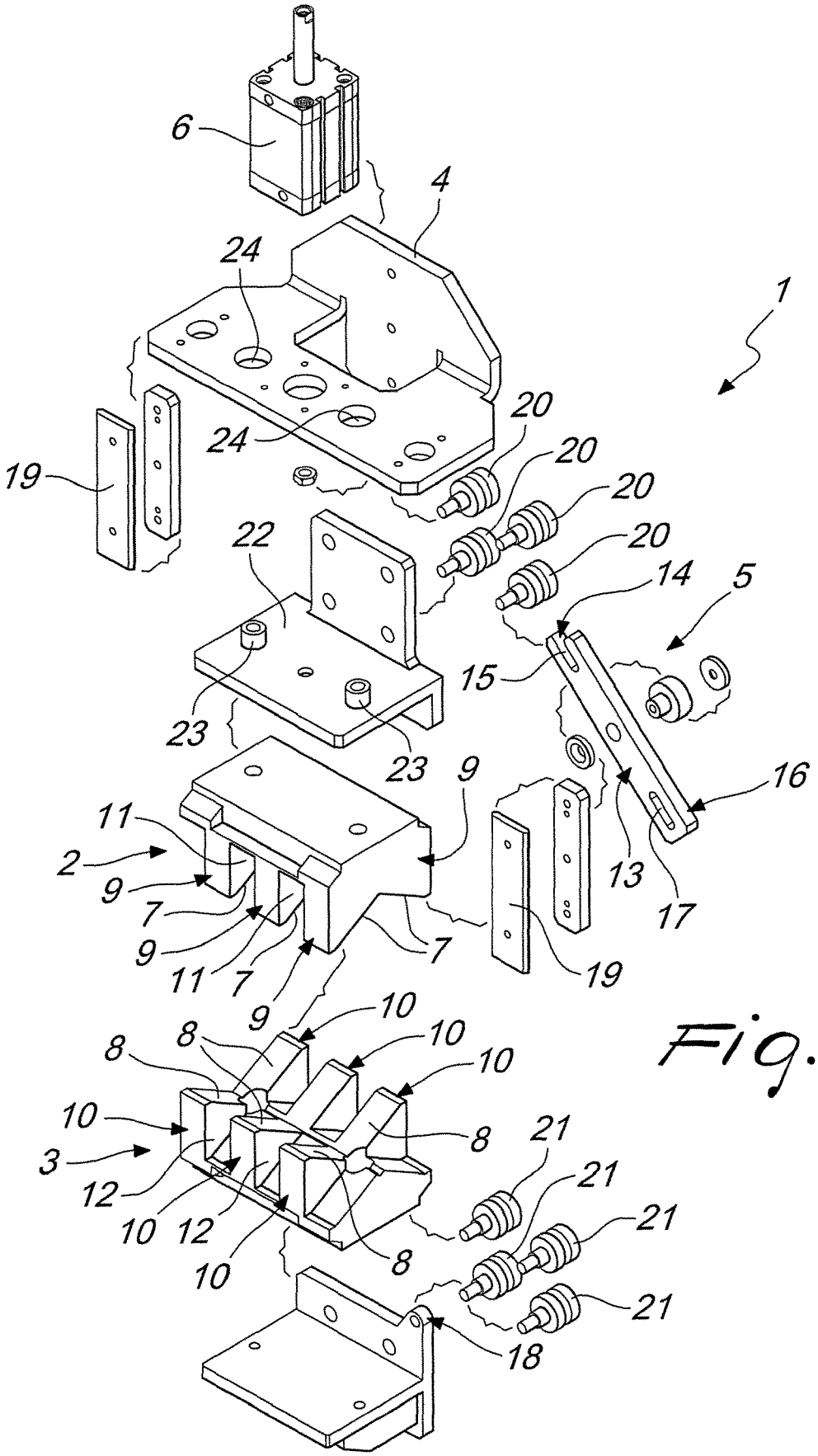
FIG. 1 is an exploded perspective view of an adjustable bar-guiding device according to the disclosure.
Figure 2:
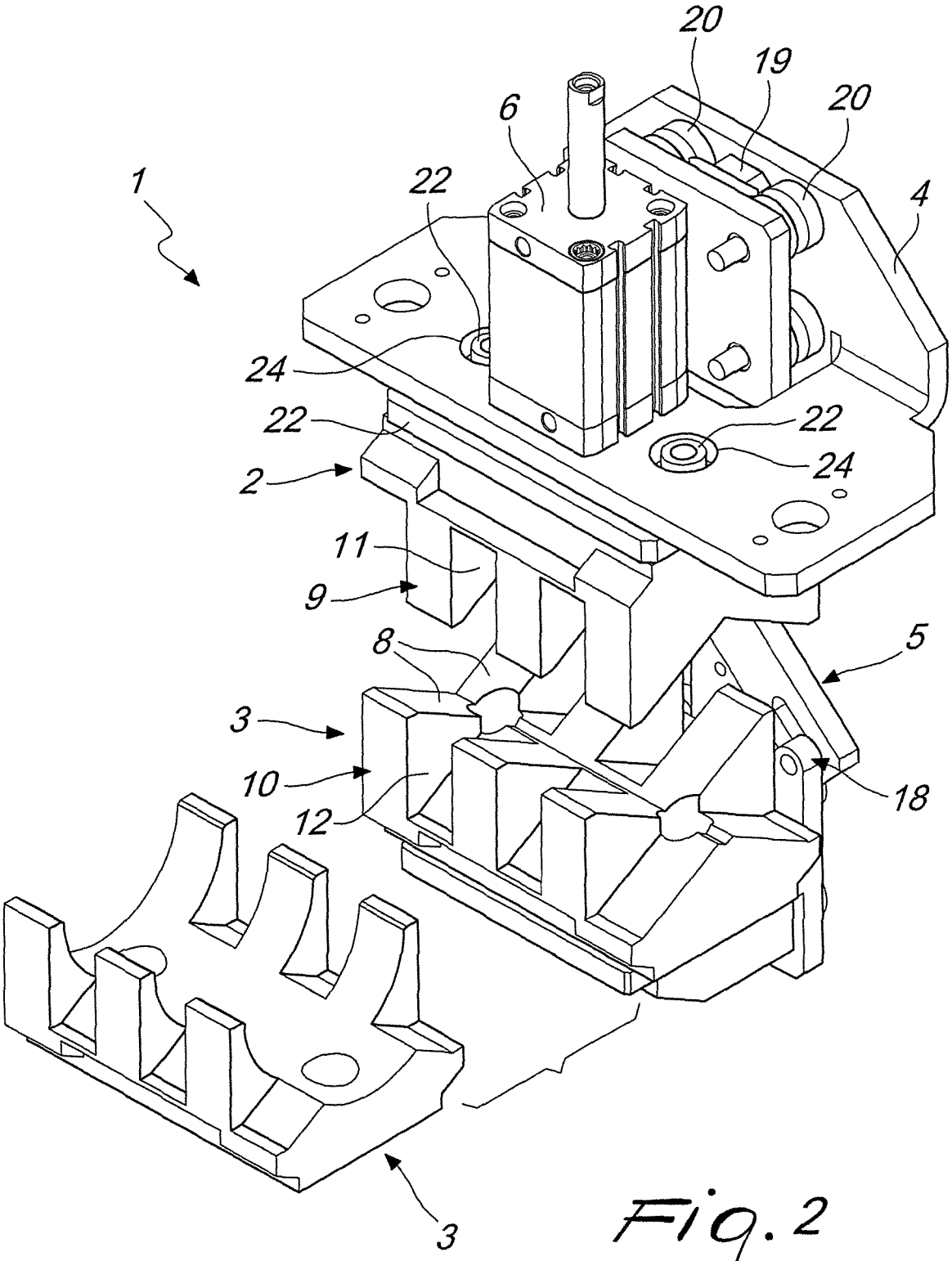
FIG. 2 is a perspective view of the device in FIG. 1, which shows a jaw of alternative shape.

With particular reference FIGS. 1 and 2, the reference numeral 1 generally designates an adjustable bar-guiding device.

The device 1 according to the disclosure comprises at least one pair of complementarily-shaped jaws 2, 3 which are slideably associated with a fixed frame 4 with the interposition of at least one movement lever mechanism 5 which is actuated by at least one fluid cylinder 6.

The jaws 2 and 3 can translate according to a stroke of mutual approach/spacing apart.

This preset stroke will occur between a first configuration of substantial juxtaposition of respective surfaces 7 and 8 of the jaws 2 and 3 and a second configuration in which such surfaces 7 and 8 are located at a predefined distance for containing a bar.

According to a particular embodiment of undoubted practical and applicative interest, the jaws 2 and 3 are at least partially made of polymeric material.

In particular, at least the surfaces 7 and 8 of such jaws 2 and 3 that face each other and are designed to abut against respective bars are made of polymeric material.

This ensures that the contact between each jaw 2 and 3 and the bar entails a polymer-metal interface (where the polymer is the material that constitutes the surface 7 or 8 of the jaw 2 or 3 and the metal is the material that constitutes the bar) which ensures that the bar cannot undergo damage or abrasion while it is being guided.

It should furthermore be noted that the surfaces 7 and 8 of the jaws 2 and 3 that face each other and are designed to abut against respective bars have a longitudinal concavity with a shape structure preferably chosen from among semi-cylindrical, semi-prismatic, V-shaped, and the like.

In this manner the mutual approach of the jaws 2 and 3 will determine the formation of a seat of shape and dimensions that correspond to those of the bar to be guided.

It should be noted that for bars having a circular cross-section, the embodiment that has V-shaped longitudinal concavities (i.e. cavities constituted by incident planes defining an angle of predefined extent) is preferable, as this version makes it possible to effectively clamp and guide many and different bar diameters.

However, in the case of guiding bars with a polygonal cross-section it is generally preferable to adopt jaws 2 and 3 with semi-cylindrical longitudinal concavities, which enable a better stability of immobilization for this kind of bars.

Further particular shape structures of bars may require the adoption of jaws 2 and 3 with differently-shaped longitudinal concavities, which are also covered in the scope of protection defined by this disclosure.

With particular reference to a version of undoubted effectiveness and certain practical application, the surfaces 7 and 8 of the jaws 2 and 3 that face each other and are designed to abut against respective bars can positively comprise a plurality of contoured teeth 9 and 10, which are separated by respective recesses 11 and 12 and arranged in two substantially symmetrical and mirror-symmetrical rows.

With particular reference to such version, the contoured teeth 9 of a first jaw 2 will be conveniently aligned with corresponding recesses 12 of a second jaw 3, while the contoured teeth 10 of a second jaw 3 will be positively aligned with corresponding recesses 11 of a first jaw 2.

Such implementation structure ensures that, in the first configuration of substantial juxtaposition of the respective surfaces 7 and 8 of the jaws 2 and 3, the teeth 9 or 10 of one jaw 2 or 3 are accommodated in the recesses 11 or 12 of the other jaw 3 or 2.

In order to enable optimal and particularly efficient operation, the at least one fluid cylinder 6 can advantageously be a pneumatic cylinder that has its moving piston coupled with one of the jaws 2 and 3.

Such pneumatic cylinder can conveniently be a double-acting cylinder: the introduction of compressed gas into a first chamber will therefore determine an advancement stroke of the corresponding piston, while the introduction of compressed gas into a second chamber will determine a retraction stroke of the corresponding piston; but if an identical pressure regime is created in both chambers, this will determine the immobilization of the piston, with the possibility of respective movement by external forcing. The piston therefore in this latter case will behave very similarly to a gas-operated spring.

It is relevant that the pneumatic cylinder in use has a through stem, and therefore the surfaces on which the air acts in the two chambers are mutually identical. This particular implementation architecture ensures a perfect balancing of the forces when the air is at the same pressure in both chambers.

This particular opportunity to use the pneumatic cylinder as a gas-operated spring will be particularly useful when guiding a bar that, during its axial rotation, causes vibrations: the cylinder will therefore dampen such vibrations by virtue of its behavior as an elastic damper.

From an implementation point of view, it should be noted that the at least one movement lever mechanism 5 could positively comprise a rocker arm 13 which is pivoted to the fixed frame 4.

A first end 14 of the rocker arm 13 could conveniently comprise a first grooved guide 15 for a protrusion of the first jaw 2. Such protrusion (not visible in the accompanying figures) will be accommodated within the first grooved guide 15 when the device 1 is in the configuration of use.

A second end 16 of the rocker arm 13 can conveniently comprise a second grooved guide 17 for a projection (integral with the edge 18) of a second jaw 3. Such projection (not visible in the accompanying figures) will be accommodated within the second grooved guide 17 when the device 1 is in the configuration of use.

Upon a translation of the first jaw 2, the sliding of the protrusion within the first guide 15 will determine the rotation of the rocker arm 13 and the sliding of the projection within the second guide 17 with consequent translation of the second jaw 3 along the same vector as the first, but in the opposite direction.

Therefore a single action of the pneumatic cylinder 6 will correspond to the simultaneous closing or the simultaneous opening of the jaws 2 and 3.

It should furthermore be noted that the frame 4 can advantageously comprise a conveyor band 19 which is arranged along the movement direction of the jaws 2 and 3.

With particular reference to such embodiment, each jaw 2 and 3 will conveniently comprise respective mutually opposing rollers 20 and 21 which are arranged at a mutual distance that corresponds to the width of the band 19.

In the configuration of use the band 19 will therefore be interposed between the rollers 20 and 21 in order to convey each jaw 2 and 3 along the respective preset stroke.

Again in order to ensure the correct operation of the jaws 2 and 3 (and their aptitude to support the bar in the ideal manner), it should be noted that at least one of them can conveniently comprise a respective support 22 which is provided with channels 23 that are designed for feeding lubricant fluid. For a correct coupling, in such case the frame 4 will comprise respective holes 24 for the slideable accommodation of such channels 23 and of the tubes connected thereto.

It should be noted that the rocker arm 13 behaves like a synchronization link rod, i.e. designed to ensure the centering of the seat defined between the surfaces 7 and 8 of the jaws 2 and 3 while closing, with respect to the guide channel.

The disclosure described is subject to the above-mentioned problems of relative sliding between the surface of the bar and that of the surfaces 7 and 8 (which are made of polymeric material) of the jaws 2 and 3.

In order to overcome such drawback, pneumatic immobilization of the cylinder 6 is adopted, which makes it possible to place the device 1 under conditions of nil pushing force on the bar during machining.

Such use mode is obtained by virtue of the following sequence of use:

- descent of the piston of the cylinder 6 with consequent approach of the surfaces 7 and 8 of the jaws 2 and 3 to the outer surface of the bar, with consequent contact thereof;
- interruption of the introduction of compressed gas into the rear chamber of the cylinder 6 upon reaching of the arrangement wherein the bar is clamped;
- compensation of the pressure in the front chamber of the piston until a condition is reached wherein the same pressure is in both chambers (the piston of the cylinder 6 in such condition will be exerting a nil pushing force on the bar);
- machining of the bar;
- release of the rear chamber of the cylinder 6 with consequent opening (mutual spacing apart of the jaws 2 and 3).

The sequence of operations described makes it possible for the piston of the cylinder 6, during the machining, not to exert any thrust on the bar, while still being locked in the final position it reached, which ensures an effective clamping thereof.

This result can be obtained, for example, through the use of a 5/3 pneumatic valve with closed centers which will feed the two chambers of the cylinder 6 at different time moments.

It should be noted that, within the scope of the version explained above by way of non-limiting example, it will also be possible to furthermore use a 3/2 valve which will act as a stop for the rear chamber of the cylinder 6 (the pusher chamber), when the "compensation" front chamber is fed.

This immobilization criterion will make it possible to maintain, in the piston of the cylinder 6, an immobilizing force that does not tend to infinity, as would happen with a stem-immobilizer of the mechanical type.

The use of air (of compressed gas) and the exploitation of the characteristic of compressibility of gases makes it possible for the piston of the cylinder 6 to withstand a defined level of stresses, beyond which the immobilization will no longer be rigid but will permit oscillations, thus acting as a damper for the vibrations generated by the rotating bar.

This tendency to trigger oscillations (during the machining) is encountered much more readily with bars of large diameter, in which the forces that are generated are much higher owing to the larger mass of the bar.

As previously mentioned, different types of jaws 2 and 3 have been developed according to the type of bar to be machined.

The solution of maximum flexibility entails jaws 2 and 3 made of polymeric material (typically Polyurethane T5) with a V-shaped cross-section, which do not require substitution (as a function of the variations in diameter of the bar on which to work) and which maintain a constancy of contact on all diameters of round bars.

For contoured bars, or in any case for reasons of maximum performance, the possibility exists of opting for the substitution of V-shaped jaws 2 and 3 with a more indicated circular (semi-cylindrical) cross-section, designed to minimize the impacts between the faces of the bar and those of the jaws 2 and 3.

If jaws 2 and 3 are used that have a semi-cylindrical seat of predefined diameter, then it becomes necessary to carry out the operation to substitute the jaws 2 and 3 according to the dimensions of the bar, at re-setup time (operations to change format).

By way of example it should be noted that, for the purpose of speeding up the substitution times, the fixing of the jaws 2 and 3 occurs by way of snap-fitting (i.e. a shape interlocking that takes advantage of the deformability of the polymeric material) and has a lubrication circuit at the fixing mechanisms.

During development, it was planned to use a cylinder 6 with a normal stem (instead of a through stem), but the difference in surface caused by the presence of the stem at only one end of the cylinder 6 does not ensure the constancy of the immobilization and, especially, it does not cancel out the pushing force of the jaws 2 and 3 on the bar.

The device, as a result of how it was conceived and developed, enables the use of the jaws 2 and 3 even when the bar is running out and the pusher wand is advancing.

In this eventuality, the function of the jaws 2 and 3 will be to immobilize the bar-pusher in order to limit the transmission of vibrations that may arrive from the bar held by the respective gripper.

On the basis of the above explanation, it is evident that the adjustable bar-guiding device 1 according to the disclosure has the capacity for self-adjustment (therefore applying the ideal clamping according to the bar on which it is working). This characteristic makes it different from and better than all conventional bar-guiding devices, which require the operator to intervene on the control panel to change the setting when it is necessary to change the diameter of the bar to be machined.

Advantageously the present disclosure solves the above mentioned problems, by providing an adjustable bar-guiding device 1 that does not require the intervention of the operator for operations to change format (or in any case minimizes such interventions). Positively, such adjustment is automatic.

Conveniently, the device 1 according to the disclosure has a simple structure.

Conveniently, the device 1 according to the disclosure is constituted by commercial components and/or components that are easily sourced.

Positively the present disclosure makes it possible to provide an adjustable bar-guiding device 1 that is easily and practically implemented and is low cost: these characteristics make the device 1 according to the disclosure an innovation that is safe in use.

The disclosure, thus conceived, is susceptible of numerous modifications and variations, all of which are within the scope of the appended claims. Moreover, all the details may be substituted by other, technically equivalent elements.

In the embodiments illustrated, individual characteristics shown in relation to specific examples may in reality be interchanged with other, different characteristics, existing in other embodiments.

In practice, the materials employed, as well as the dimensions, may be any according to requirements and to the state of the art.

The invention claimed is:

1. An adjustable bar-guiding device comprising: at least one pair of complementarily-shaped jaws slideably associated with a fixed frame with the interposition of at least one movement lever mechanism which is actuated by at least one fluid cylinder, said jaws performing a translational motion according to a stroke of mutual approach/spacing apart, between a first configuration of substantial juxtaposition of respective surfaces of said jaws and a second configuration in which said surfaces are located at a predefined distance for containing a bar, wherein the surfaces of said jaws that face each other and are configured to abut against respective bars comprise a plurality of contoured teeth, which are separated by respective recesses and arranged in two substantially symmetrical and mirror-symmetrical rows, wherein said contoured teeth of a first jaw are aligned with corresponding recesses of a second jaw and said contoured teeth of a second jaw are aligned with corresponding recesses of a first jaw, in said first configuration of substantial juxtaposition of respective surfaces of said jaws the said teeth of one said jaw being accommodated in the recesses of the other said jaw.

2. The device according to claim 1, wherein said jaws are at least partially made of polymeric material, at least the surfaces of said jaws that face each other and are configured to abut against respective bars made of polymeric material.

3. The device according to claim 1, wherein the surfaces of said jaws that face each other and are configured to abut against respective bars have a longitudinal concavity with a shape structure preferably chosen from among semi-cylindrical, semi-prismatic, and V-shaped.

4. The device according to claim 1, wherein said at least one fluid cylinder is a pneumatic cylinder that has a moving piston coupled with one of said jaws.

5. The device according to claim 4, wherein said pneumatic cylinder is a double-acting cylinder, the introduction of compressed gas into a first chamber determining an advancement stroke of the corresponding piston, the introduction of compressed gas into a second chamber determining a retraction stroke of the corresponding piston, the creation of an identical pressure regime in both chambers determining the immobilization of the said piston with the possibility of respective movement by external forcing with behavior comparable to that of a gas-operated spring.

6. An adjustable bar-guiding device comprising: at least one pair of complementarily-shaped jaws slideably associated with a fixed frame with the interposition of at least one movement lever mechanism which is actuated by at least one fluid cylinder, said jaws performing a translational motion according to a stroke of mutual approach/spacing apart, between a first configuration of substantial juxtaposition of respective surfaces of said jaws and a second configuration in which said surfaces are located at a predefined distance for containing a bar, wherein said at least one movement lever mechanism comprises a rocker arm pivoted to said fixed frame, a first end of said rocker arm comprising a first grooved guide for a protrusion of a first jaw, which is accommodated therein in the configuration of use, a second end of said rocker arm comprising a second grooved guide for a projection of a second jaw, which is accommodated therein in the configuration of use, upon a translation of said first jaw the sliding of said protrusion within said first guide determining the rotation of said rocker arm and the sliding of said projection within said second guide with consequent translation of said second jaw along the same vector as the first jaw but in the opposite direction.

7. An adjustable bar-guiding device comprising: at least one pair of complementarily-shaped jaws slideably associated with a fixed frame with the interposition of at least one movement lever mechanism which is actuated by at least one fluid cylinder, said jaws performing a translational motion according to a stroke of mutual approach/spacing apart, between a first configuration of substantial juxtaposition of respective surfaces of said jaws and a second configuration in which said surfaces are located at a predefined distance for containing a bar, wherein said fixed frame comprises a conveyor band arranged along the movement direction of said jaws, each jaw comprising respective mutually opposing rollers arranged at a mutual distance that corresponds to a width of said band, in a configuration of use said band being interposed between said rollers in order to convey each jaw along the respective preset stroke.

8. An adjustable bar-guiding device comprising: at least one pair of complementarily-shaped jaws slideably associated with a fixed frame with the interposition of at least one movement lever mechanism which is actuated by at least one fluid cylinder, said jaws performing a translational motion according to a stroke of mutual approach/spacing apart, between a first configuration of substantial juxtaposition of respective surfaces of said jaws and a second configuration in which said surfaces are located at a predefined distance for containing a bar, wherein each said jaw comprises a respective support which is provided with channels that are configured for feeding lubricant fluid, said fixed frame comprising holes for a slideable accommodation of said channels.

* * * * *